United States Patent [19]

Michel et al.

[11] Patent Number: 4,934,361

[45] Date of Patent: Jun. 19, 1990

[54] RESPIRATOR

[75] Inventors: John M. Michel, Coatesville; James P. Kline, Reading, both of Pa.

[73] Assignee: WGM Safety Corp., Reading, Pa.

[21] Appl. No.: 300,355

[22] Filed: Feb. 17, 1989

Related U.S. Application Data

[62] Division of Ser. No. 921,139, Oct. 26, 1986, Pat. No. 4,850,346.

[51] Int. Cl.[5] ..... A62B 7/00

[52] U.S. Cl. ..... 128/206.17

[58] Field of Search ..... 128/205.29, 206.12–206.17, 128/206.18; 55/DIG. 33, 35

[56] References Cited

U.S. PATENT DOCUMENTS

| | | | |
|---|---|---|---|
| 2,505,173 | 12/1948 | Conley . | |
| 2,652,828 | 3/1951 | Matheson . | |
| 2,701,030 | 2/1955 | Hazelton | 128/205.29 X |
| 2,744,524 | 5/1956 | Whipple . | |
| 2,744,525 | 5/1956 | Whipple . | |
| 3,307,543 | 3/1967 | Silverman | 128/206.17 |
| 4,179,274 | 12/1979 | Moon . | |
| 4,453,544 | 6/1984 | Silverthorn | 128/206.17 |
| 4,573,464 | 3/1986 | Yo | 128/206.17 X |
| 4,592,350 | 6/1986 | Maryyanek et al. | 128/206.17 |
| 4,686,976 | 8/1987 | Bakkila . | |
| 4,688,567 | 8/1987 | Kikuchi et al. | 128/206.15 |

*Primary Examiner*—Angela D. Sykes

*Attorney, Agent, or Firm*—Charles H. Lindrooth

[57] ABSTRACT

Breathing equipment, e.g., a half mask-type respirator, is disclosed. A mask is provided with three ports of common dimension in any one of which inhalation or exhalation fittings housing inhalation or exhalation valves may be mounted. Disclosed are chemical and mechanical filtration cartridges usable alternatively or in combination. Disposable chemical filtration cartridges having novel lock and seal structure are disclosed. Bayonet-type couplings for coupling the filter housings to the inhalation respiratory fittings and an audible device to indicate that the filter housings are properly coupled are disclosed. The respirator valve is a thin umbrella-shaped disk valve having a multiplicity of radiating ribs which biases the valve to the closed position. A novel crown strap suspension is also provided.

6 Claims, 8 Drawing Sheets

FIG. 9
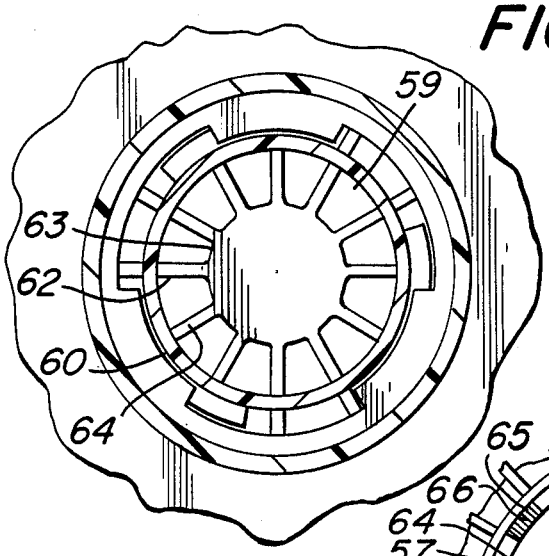
FIG. 10
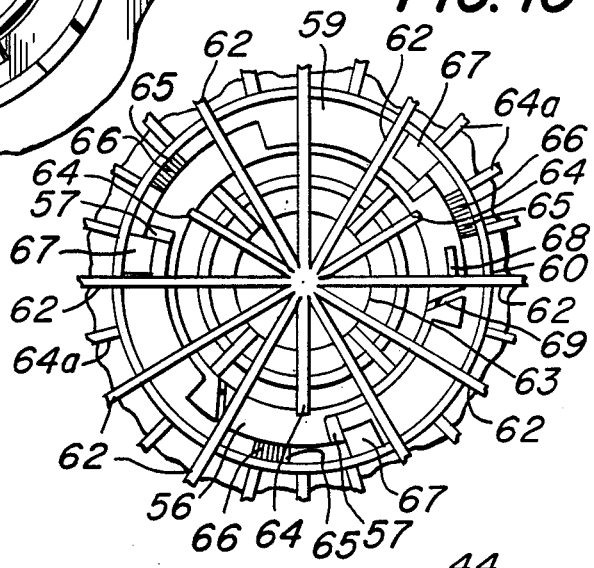
FIG. 12
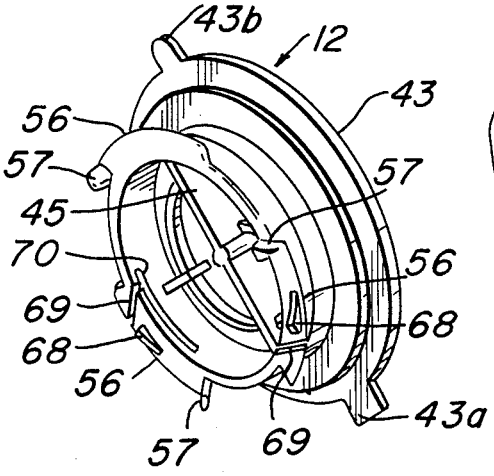
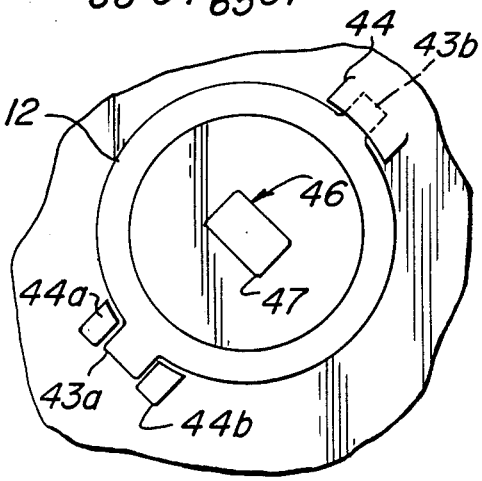
FIG. 11

RESPIRATOR

This is a divisional application of co-pending application Ser. No. 06/921,139 filed on Oct. 26, 1986, now U.S. Pat. No. 4,850,346.

FIELD OF THE INVENTION

This invention relates to breathing equipment and in particular to respirators providing protection from airborne contaminants including particulate matter, as well as gases and vapor. Although not limited thereto, the invention is particularly directed to a face piece respirator, of the type including a face mask configured to concurrently enclose the mouth and nasal passages of the user and having a plurality of respiration ports with fittings housing one or more inhalation valves and an exhalation valve.

BACKGROUND OF THE INVENTION AND PRIOR ART

Respirators of the type to which the invention most nearly relates are those which utilize a half mask covering the mouth and nasal passage area, although various aspects of the invention relate as well to the so-called full-face mask respirators which not only cover the nose and mouth but provide protection for the face and eyes as well. Both the half mask and full-face respirators are provided with inhalation valves over which is mounted a replaceable filter or adsorptive cartridge so that contaminant-free air is drawn through the valves. The filter may be a mechanical filter element comprised of a fibrous filter material which provides protection against particulate matter such as dusts, mists or metal fumes, or a chemical filter media having a high adsorption capability, providing protection from gases and vapors. Generally, granular-activated carbon is utilized as the chemical adsorption media. Chemical and mechanical filters may be used independently or in combination in a single filter housing. Face masks respirators quite commonly utilize the so-called dual chemical cartridges with the cartridges mounted over inhalation valves located on each side of the face piece with a centrally-located valve in the mask being provided for exhalation. An alternative arrangement, preferred by some because peripheral vision is less restricted, provides a single cartridge and inhalation valve centrally mounted on the face piece with an exhalation valve mounted to one side. The present invention is adapted to be utilized in either configuration.

Known prior art includes: U.S. Pat. No. 2,640,481 to T. A. Conley, issued June 2, 1953; U.S. Pat. No. 3,744,524 to W. Z. Whipple, issued May 8, 1956; U.S. Pat. No. 4,179,274 to Moon, issued Dec. 18, 1979; U.S. Pat. No. 4,414,973 to Matheson et al, issued Nov. 15, 1983; U.S. Pat. No. 4,501,272 to Shigematsu et al, issued Feb. 26, 1985; and U.S. Pat. No. 4,592,350 to Maryyanek et al, issued June 3, 1986.

OBJECTS AND ADVANTAGES OF THE INVENTION

An important object of the invention relates to improvements in face mask respirator design which enhance comfort, safety, convenience of use and efficiency.

Another object of the invention is the provision of respirator improvements which maximize the delivery of purified air to the user while minimizing air flow resistance.

A further object of the invention is the provision of chemical cartridges and cartridge mounting systems minimizing the potential for leakage of unfiltered air into the respirator.

Still a further object of the invention relates to improvements in exhalation valve construction which improves reliability, prevents leakage and is more responsive to expiration effort on the part of the user.

Still further objects of the invention relate to an improved cradle suspension system which provides for increased comfort for the user, simplification of adjustment of the respirator and more effective support and even distribution of pressure to the face mask and to the face of the user.

Still another object of the invention is the provision of a face mask respirator of great versatility in that different chemical cartridges and mechanical filter combinations and configurations may be readily used depending upon the wishes and needs of the user. With this objective in view, the invention enables the ready change of the respirator from the so-called dual cartridge-type to a mono-cartridge-type respirator wherein a single cartridge is centrally located on the respirator face piece. Still further it is an aspect of this objective of the invention that mechanical filters alone, chemical cartridges alone or a combination of the two, may be conveniently employed.

Other objects and advantages will become apparent from the following detailed description of a preferred embodiment of the invention.

Figure 2:
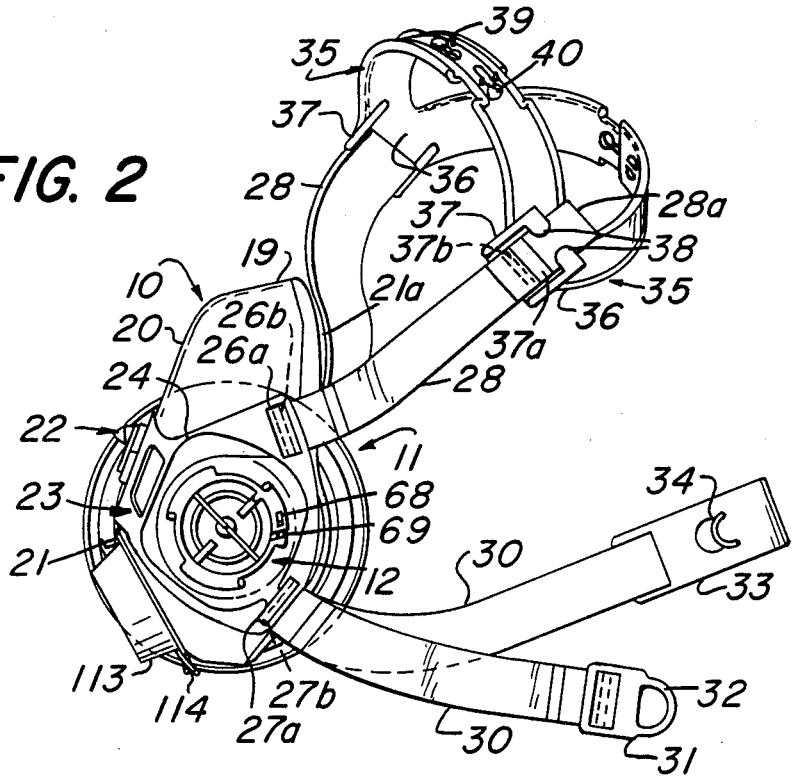
FIG. 2 is a side view of the respirator of FIG. 1 with the right-hand cartridge element removed for purposes of illustration of an inhalation valve fitting.
Figure 3:
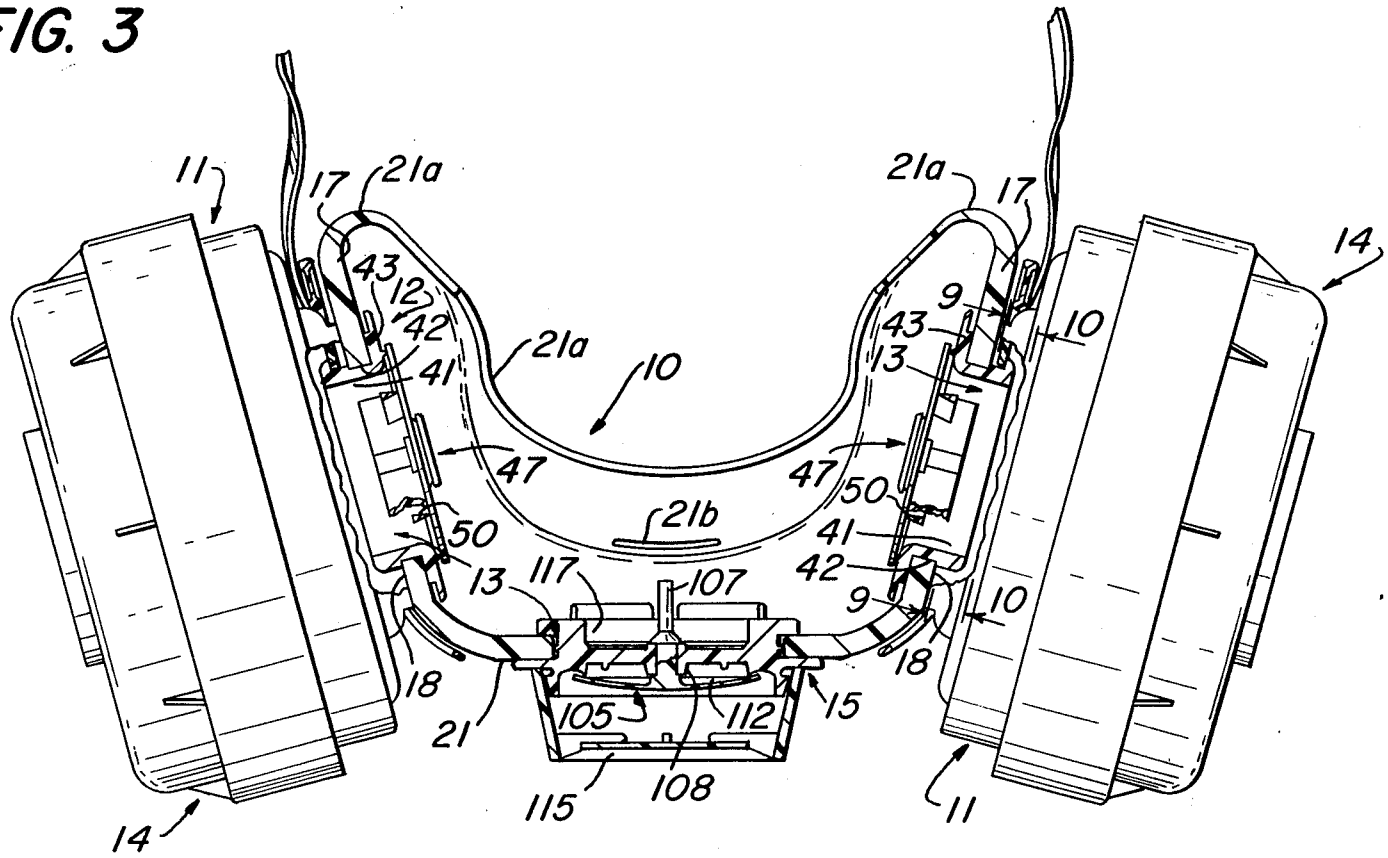
FIG. 3 is a partial sectional view taken on line 3—3 of FIG. 1.
Figure 6:
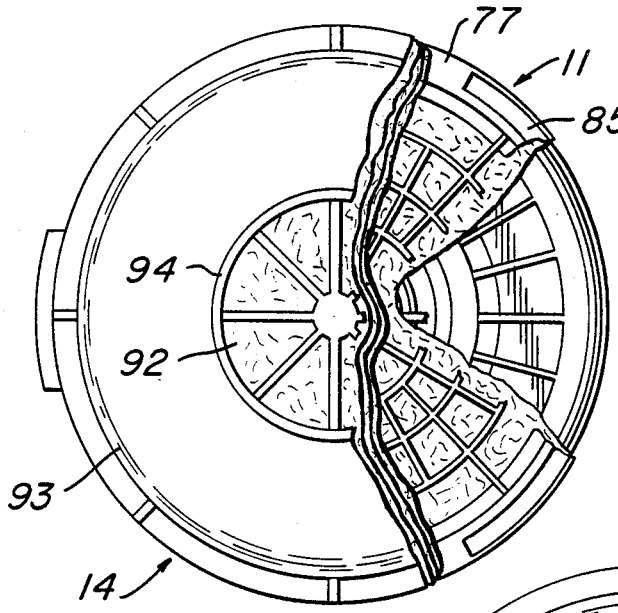
FIG. 6 is a cut-away view in plan view of a cartridge with mechanical filter and filter retainer attached.
Figure 7:
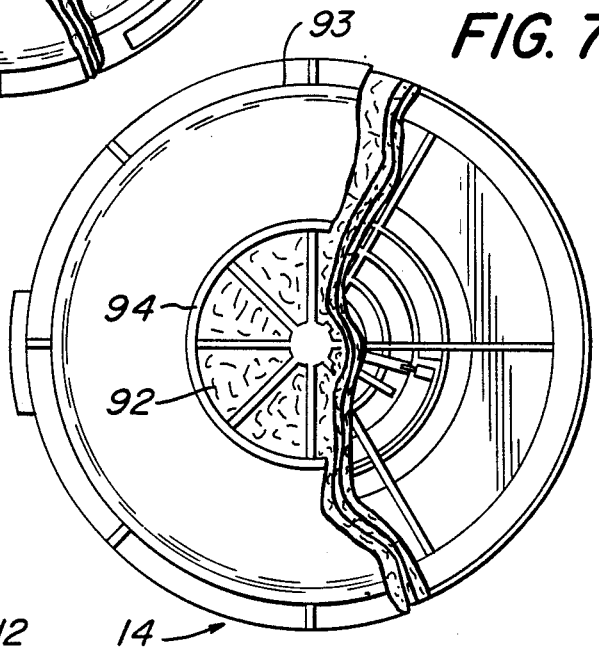
Figure 8:
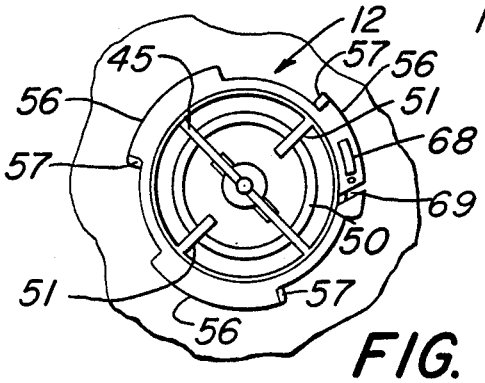
Figure 13:
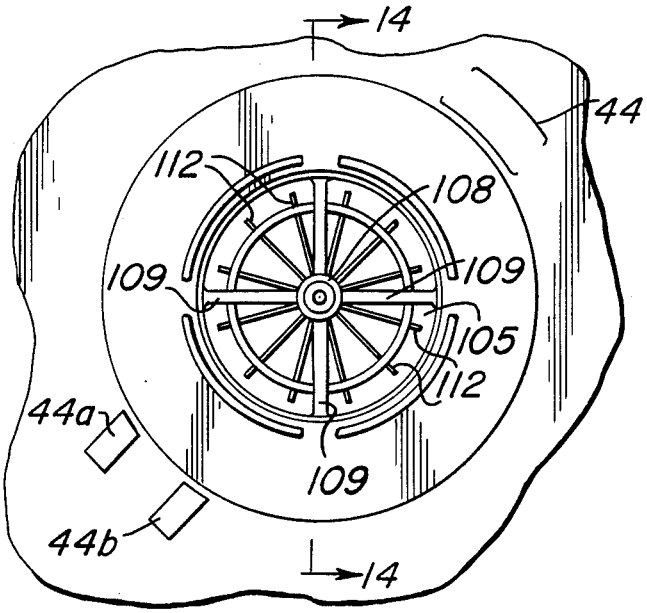
Figure 14:
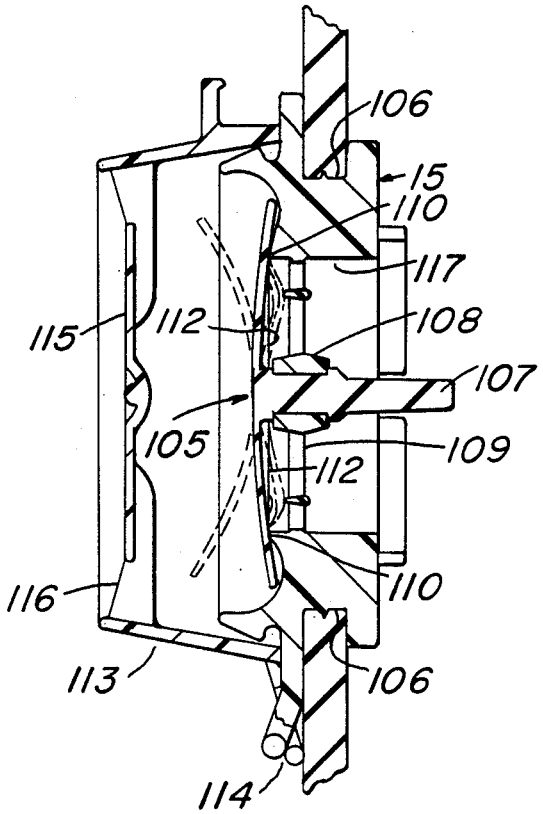

FIG. **6*a* is a view taken on line 6*a*—6*a* of FIG. 6**;

FIG. 7 is a view similar to FIG. 6 showing a view with the lid of the chemical cartridge and its contents removed;

FIG. 8 is a view on an enlarged scale of the inhalation valve illustrated in FIG. 2;

FIG. 9 is a sectional view taken on line 9—9 of FIG. 3;

FIG. 10 is a sectional view taken on line 10—10 of FIG. 3;

FIG. 11 is a fragmentary view taken from inside the face mask illustrating the opposite side of the inhalation valve shown in FIGS. 2 and 8;

FIG. 12 is a perspective view of the inhalation valve shown in FIGS. 2 and 8;

FIG. 13 is a view of the exhalation valve taken interiorly of the face mask; and FIG. 14 is a sectional view taken on 14—14 of FIG. 13.

DETAILED DESCRIPTION OF THE PREFERRED EMBODIMENT

Figure 1:
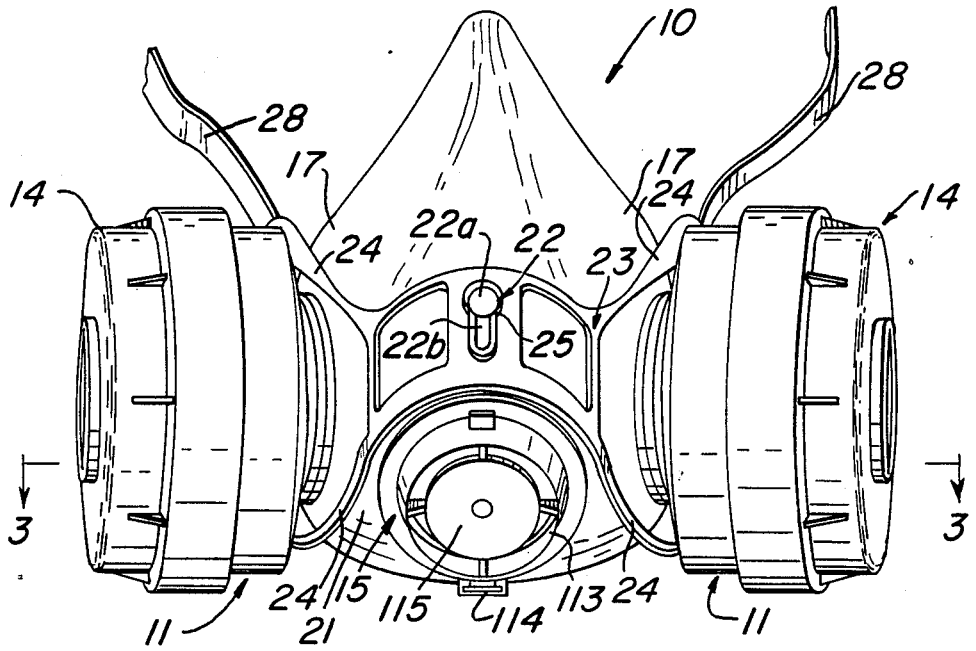
FIG. 1 is a front view of a respirator incorporating the principles of the invention.

With reference first to FIGS. 1 and 2, the respirator of the preferred embodiment of the invention is comprised of a face mask 10 of the so-called half mask type. Chemical cartridges 11 are shown as being attached to the upstream side of inhalation valve housings or fittings 12 in which are mounted flexible disk-type inhalation valves. The face piece is provided with a central port and two side ports 13, shown in FIG. 3 which extend through the side walls of the face mask. Each of the inhalation valve fittings may be interfitted into any one of three ports 13. The side ports are preferably set well to the sides of the face mask so that the cartridges are close to the face and out of the line of vision insofar as is practical.

A filter retainer 14 which houses a mechanical filter in a manner to be described hereinafter may be mounted on each chemical cartridge 11, as illustrated in FIG. 1. The respirator is further provided with an exhalation valve housing or fitting generally indicated by the number 15, which houses a disk-type exhalation valve described hereinafter. In FIG. 1, the exhalation valve fitting is mounted in the port in the central region of the face mask, generally in front of the mouth and nasal passages of the user.

In its preferred embodiment, the respirator face mask of FIGS. 1–3 has three generally circular ports 13 of common diameter. The respirator inhalation fitting 12 and exhalation fitting 15 have a cylindrically-grooved portion of diameter the same as each of the circular ports, thereby permitting alternative mounting of any one of the valve fittings either in the port located in the center region of the face mask or in the ports located in the region offset toward the sides of said central region. Thus, if desired by the user, the inhalation valve fitting may be mounted in the central port with an enlarged chemical or mechanical filter housing providing for filtered air through that port and one exhalation valve mounted in one of the ports offset to the side of the central port. If this configuration is employed, a fitting dimensioned the same as fitting 12 or 15 but having no opening therein is inserted into the other side port so as to prevent the flow of air into or out of the face mask except through the inhalation and exhalation valves.

Preferably, face mask 10 is molded of silicone rubber or like resilient pliant material. The face mask has inclined side walls 17 which incline downwardly and outwardly from an apex which is intended to fit over the bridge of the nose of the user to flatted side surfaces 18 in each one of which the circularly-shaped respirator ports 13 are provided. As viewed in FIG. 2 in profile, the wall portion slopes gradually outwardly from the apex as shown at 19 to clear the nose and then slopes downwardly more sharply as indicated at 20 to an inwardly directed region 21 seen in FIG. 3 in which the third or centrally located respirator port 13 is provided. The face piece is provided with an in-turned flexible sealing lip or flange **21*a* having a generous radius which extends around the entire edge which is intended to come into contact with the face of the user. This flange is contoured generally to conform to and form a leak-free seal with the user's face. The material of the wall portion has sufficient inherent flexibility and its thickness is selected so that it readily conforms to the facial structure of a wide range of potential users. The wall portion is of substantially uniform thickness and defines a chamber which provides for intercommunication between the user's mouth and nasal passages. Preferably, the bottom of flange 21*a* is provided with a relief port 21*b*** through which perspiration from the facial region within the face mask can flow away from the seal with the face. Any perspiration flows into the chamber and out through the expiration valve.

The system for supporting the face mask on the face of the user will now be described. Located just above the port in the central region is an outwardly projecting key-shaped stud 22 which is preferably molded or formed as an integral part of the face mask 10. Although the stud 22 may take other forms, it preferably has an enlarged head portion **22*a* and an elongated body portion 22*b*. A halter or yoke 23 preferably formed of a material having sufficient flexibility and resilience to readily conform to the contour of the face mask is provided with structural ring portions 24 which fit around the respirator ports in the side wall portions in the face mask. A centrally-located slot or opening 25 which is shaped to the same configuration as stud 22 is formed in the yoke and is adapted to be snap-fitted over the enlarged head portion 22*a*. The yoke 23 also has fastening means for the attachment of suspension straps. Preferably, the fastening means comprises upper and lower pairs of strap attachment slots 26*a* and *b* and 27*a* and *b* located laterally to the sides of the ring portions 24 as shown in FIG. 2. The slots 26*a* and *b* are fitted with an elastic strap element 28, the end of which is passed through slot 26*a*, around the bar of material separating the pair and back through slot 26*b*. The end of an elastic neck strap 30 is passed through slot 27*a*, around the bar separating the pair and back through slot 27*b*. One of the neck straps 30 is provided with a fastening element 31 having a D-ring 32 and the other is provided with a fastening element 33 having a hook 34 which is hooked within ring 32** behind the neck of the user.

As shown in FIG. 2, each of the elastic straps 28 is adjustably fastened to one of a pair of crown strap elements 35 preferably molded of a resilient flexible plastic material. Each crown strap element 35 is an integral unit, preferably of molded plastic material, with a pair of arms diverging outwardly in V-shaped fashion from an apex 36. A strap fastening means is integrally formed in each crown strap at apex 36. Preferably, the fastening means comprises a buckle-shaped frame 37 in which a pair of slots **37*a* and *b* are formed. Strap end retainer lugs 38 extend upwardly from the sides of the frame 37. The end of each strap is passed outwardly through slot 37*a* around the bar of material separating the slots of a pair and back through slot 37*b*. The ends of the straps may then be held by the lugs 38** so that a strap and is not left dangling to the annoyance of the user.

Each V-shaped crown strap element 35 further has a plurality of studs 39 spaced lengthwise of one arm and spaced openings 40 on its other arm. The studs and slots which are dimensioned to permit the studs to be interfit within the slots to give a range of size adjustment to the crown strap so that different head sizes are accommodated. When interconnected, the two-strap elements bend to form a cradle or crown which fits over and surrounds the top of the user's head.

In mounting the respirator on the face, the crown straps are interconnected in the desired adjusted position with the straps 28 interconnecting the crown strap elements 35 with the yoke. Hook 34 on one elastic neck strap 30 is thereafter hooked into D-ring 32 on the end of the other neck strap 30 and the mask is then in position. By pulling on end 28*a* of one strap 28, the appropriate amount of tension is supplied. The yoke serves to transmit uniform pressure to the respirator face piece which in turn is transmitted uniformly to the peripheral seal with the user's face. In addition, when the respirator is mounted on the face, the yoke ring structure acts to directly support the weight of cartridges 11 so that they do not act to deform the mask, possibly breaking the seal with the face.

As indicated above, inhalation valve housings or fittings 12 have common dimensions with each other and with face mask ports 13 so that each may be mounted in any one of these ports. In the preferred form, with reference to FIGS. 3 and 5, each fitting has a tubular body or sleeve portion 41 of circular cross-section and has an external circumferentially-extended grooved surface 42 of the same diameter as the face mask ports 13. The inhalation fittings 12 are further provided with a circumferentially-extending flange 43 which bears against the inner wall of the face piece. Spaced lugs 43*a* and 43*b*, shown in FIGS. 11 and 12, extend radially from flange 43. A pocket 44, shown in FIG. 11, is molded into the inside of the face mask adjacent each port. A pair of upright lugs 44*a* and *b* are preferably also molded integrally with the inne wall of the face mask at points adjacent each opening opposite to each pocket 44. Lug 43*b* of each inhalation valve fitting fits within pocket 44 whereas lug 43*a* fits between lugs 44*a* and *b*, so that turning of the fitting relative to the face mask is prevented.

As best shown in FIG. 12, each inhalation valve fitting is further provided with a rib 45 which extends transversely of the valve opening. A centrally-located mounting stud 46, shown in FIGS. 4 and 11 which is mounted on the rib, is provided with an enlarged head 47. A disk valve formed of a thin membrane of flexible material such as polyurethane fits over the head of stud 47. Preferably, the disk valve is sufficiently deformable and elastic so as to be readily slipped over enlarged head 47 and held in place thereby. The valve fitting preferably is further provided with an annular valve support ring 50 (FIG. 8) which preferably is molded integrally with the transverse rib 45. Additional support is provided by a pair of inwardly extending support members 51, all best shown in FIG. 8.

Figure 4:
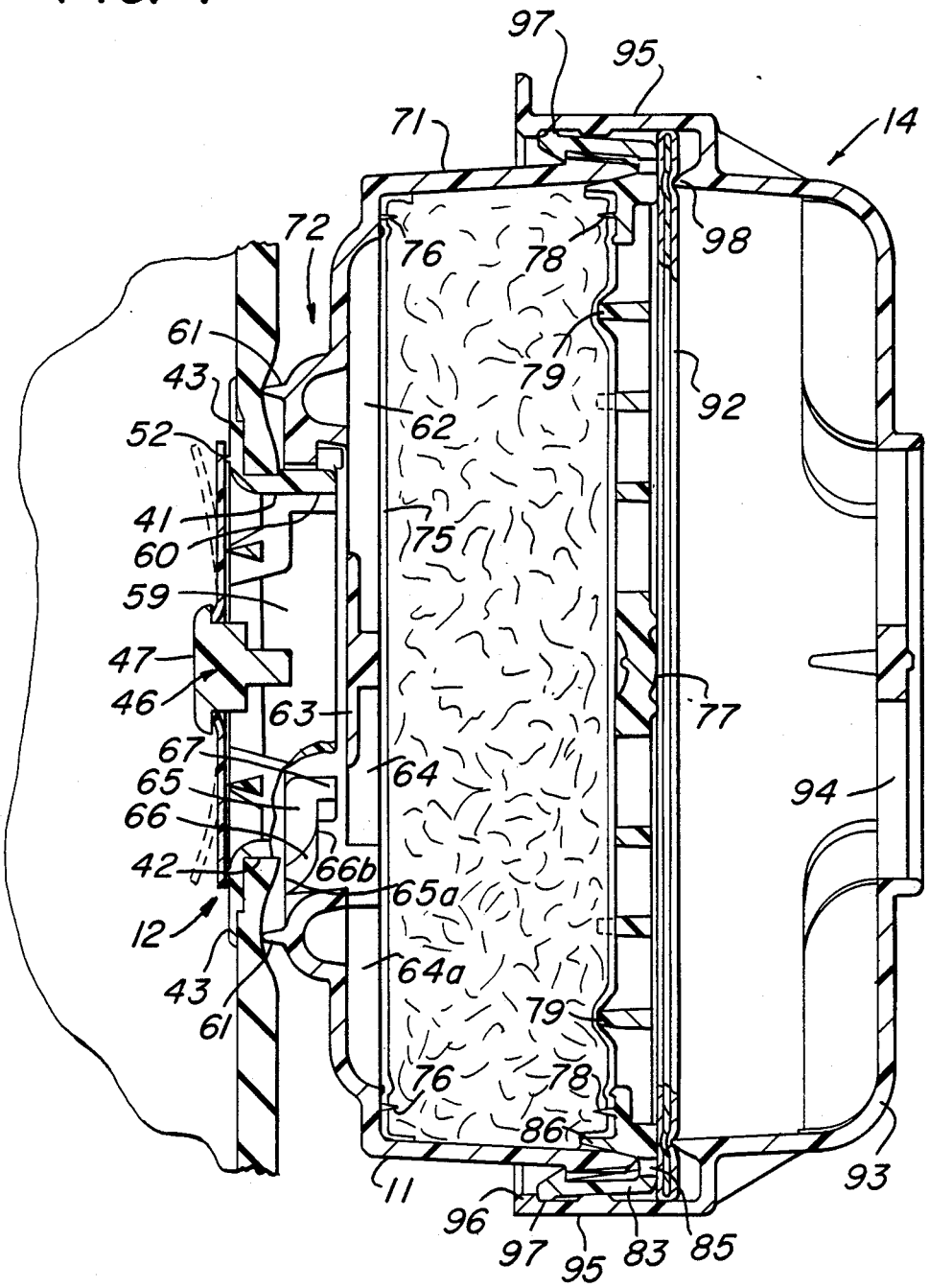
FIG. 4 is a sectional view through a mechanical filter housing, chemical cartridge and inhalation valve fitting utilized in the respirators of FIGS. 1-3.
Figure 5:
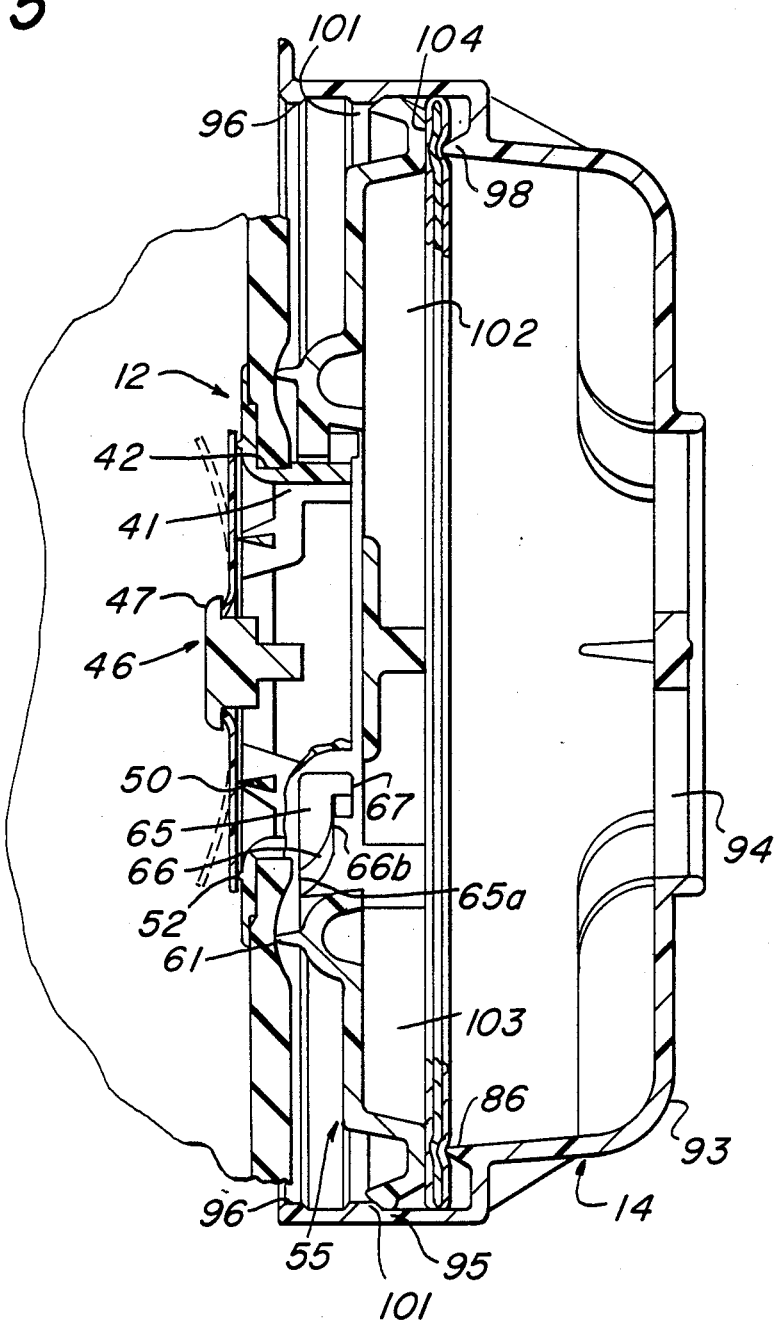
FIG. 5 is a sectional view similar to FIG. 4 showing a configuration in which a mechanical filter alone is employed.

In the closed position, as seen in FIGS. 4 and 5, the valve rests upon an annular sealing ring 52 molded into the outer surface of flange 43. The intermediate support ring 50 serves to support the valve during expiration thereby preventing exhaled air flow through the valve back into the filter media.

In order to connect the filtration cartridges to the inhalation valve fittings, means comprising a bayonet-type coupling is provided. For particulate filtration alone, there is alternatively provided a separate base member 55 shown in FIG. 5, which directly supports a mechanical-type filter. As illustrated in FIG. 5, the base member 55 also is provided with bayonet coupling parts so that it can be directly on the inhalation fitting when mechanical filtration alone is desired.

The bayonet coupling parts on the inhalation valve fitting can best be seen in FIG. 12. These preferably comprise three equi-angularly spaced apart lugs or lands 56 which extend radially outwardly from the end of the tubular part 41 opposite from flange 43. Each lug 56 has a flat entry surface portion with a stop 57 at one end thereof.

Referring now to FIG. 4 and to FIG. 10, which is a view taken interiorly of a cartridge with the filter media removed in order to illustrate the base thereof when the cartridge is mounted on the fitting 12. The cartridge base is provided with a central opening 59, defined by an annular wall 60 which merges with the cartridge base on which is formed a sealing ring 61 which functions to effect a seal with the face mask side wall.

To support the filter media, a series of radiating support ribs 62 which radiate outwardly from the center of a circular baffle element 63 are preferably molded integrally therewith as seen in FIGS. 4, 9 and 10. Additional support for the media is provided by relatively shorter ribs 64 which terminate short of the periphery of the opening 59 and a further series of ribs 64*a* which extend radially inwardly from the side walls, also terminating at the opening.

The cartridge base is also provided with three equiangularly spaced apart lugs or lands 65 extending radially inwardly from side wall 60. The upper surface of each lug 65 as viewed in FIG. 10 is axially spaced from the ribs 64 and 62 by an amount sufficient to provide clearance for lugs 56. Each lug 65 is provided with a surface 66 which inclines upwardly from lower end 65*a* to a substantially horizontal portion 65*b* (see FIGS. 4 and 5) which terminates in an upwardly extending stop 67, best shown in FIG. 10. As will be understood by those in the art, the cartridge is placed upon the fitting 12 with the lugs 65 located in the space between the lugs 56. The cartridge is then pressed inwardly and rotated relatively to the fitting in a clockwise direction so that the underside of each lug 56 rides upwardly on the inclined surfaces 66 drawing the two parts relatively toward one another until the stops 57 and 67 abut one another. In this position, the cartridge is clamped tightly to the respiratory fitting and to the face mask side wall material as seen in FIG. 4, assuring that no air leakage can take place between the fitting and the cartridge or between the cartridge and the face mask.

Preferably, audible detent means are provided as an audible indication to the user that the cartridge is properly coupled to the respiratory fitting so that air leakage cannot occur. To accomplish this, at least one of the lugs 56 is provided with a detent ramp or cam 68, as best shown in FIG. 12. Cam 68 has a relatively inclined surface which is positioned so as to gradually deflect or deform one of ribs 62 when the parts are relatively rotated. Further, the lug on which cam 68 is formed is preferably slotted and undercut as shown at 69 and 70 in FIG. 12 thereby giving the lug a degree of flexibility. As the parts are relatively rotated further, deflection of the rib and the lug occur until the rib abruptly drops off the end of the cam just as the two stop surfaces are about to interengage. This abrupt action causes the relatively flexible and resilient material of the cam and rib to produce an audible click which indicates to the user that the cartridge is properly coupled to the fitting. The cam and rib thereafter yieldably hold the cartridge in position so that the cartridge cannot be uncoupled unless a positive and deliberate torque is applied. As indicated above, rotation of the fitting 12 is prevented when the bayonet parts are coupled or uncoupled because the lugs 43*a* and 43*b* on the flange of the fitting restrain rotation of the fitting because they are in turn restrained by the face piece lugs 44*a* and *b* and pocket 44.

The construction of a typical chemical cartridge and mechanical filter retainer is best shown in FIGS. 4, 6, 6*a* and 7. The cartridge 11 comprises a cup-shaped body component with upright walls 71, and a base 72 in which the central opening 59 is formed. As indicated above, the opening receives the sleeve portion 41 of a respirator fitting 12 and is surrounded by annular sealing ring or surface 61 which forms a seal with the face mask side wall when the bayonet coupling parts are properly fastened together, as shown in FIG. 4. The media support ribs 62, 64 and 64*a* (see especially FIGS. 4 and 10) project upwardly from the base and support a porous carbon retention media 75. The cartridge is filled with activated carbon particles. Preferably, media 75 is held in place by circumferentially-disposed spikes 76 which project through the relatively easily penetrated fibrous media.

The cartridge is further provided with a lid 77 which is permanently affixed to the body by sealing means described hereinafter. A second layer of carbon retention media is provided between the carbon particles and the lid, this media also being held in place preferably by a plurality of circumferentially-disposed spikes, as shown at 78. Preferably, the lid has an integrally-formed open gridwork or grill typically composed of radiating ribs interconnected by spaced-apart annularly extending interconnecting members. Downwardly projecting studs 79 press the retention media into contact with the carbon particles so that no shifting of the carbon particles takes place. The arrangement is intended to provide for maximum circulation of air through the cartridge as the air is drawn through inhalation valve 12. In this connection, the circular piece 63 at the center of the base acts as a baffle which disperses the air flowing through the cartridge somewhat, thereby maximizing the adsorption activity by discouraging direct flow or channeling through the carbon particles.

Figure 6A:
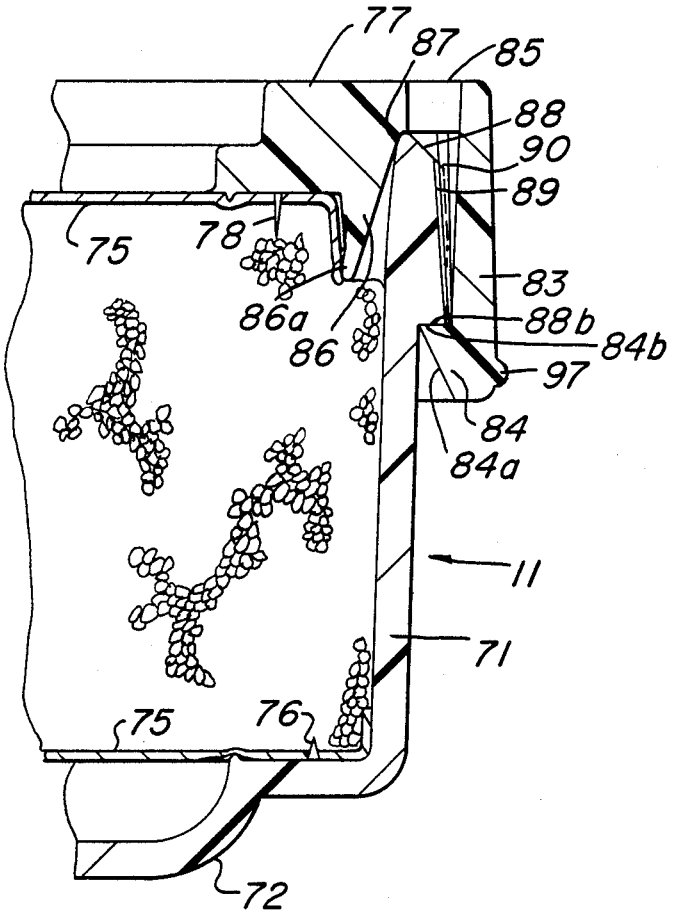

The seal between the body and the lid is best illustrated in FIG. 6*a*. As shown in that figure, the lid has a circumferentially and downwardly extending wall portion 83 at the bottom of which a multiplicity of elongated inwardly extending teeth 84 are provided. The teeth 84 are equally spaced about the lower inner surface of the rim of the wall portion 83. Each tooth has an upwardly inclined camming surface 84*a* and a locking surface 84*b* which is generally horizontally extending as the lid is viewed in FIG. 6*a*. Preferably, the wall portion in the region of the teeth 84 is provided with a degree of flexibility by providing the top of the lid adjacent the rim with spaced openings of substantially the same length as the teeth in the region over each tooth. One such opening is shown at 85 in FIGS. 6 and 6*a*. The lid is further provided with a downwardly extending annular sealing ring 86 which is spaced inwardly from the outer rim 83. Sealing ring 86 has a sealing surface which inclines upwardly at an angle of about 15° to the vertical to a point just inboard of the inner edge of the slots 85 and also has a retaining surface 86*a* against which the edge of the filter retention media abuts.

The upper end of the body member wall terminates in a relatively sharp sealing edge 87 which is adapted to bear against and mate with the inclined surface of annular sealing ring 86. An outer camming ring surface 88 extends downwardly and outwardly from the rim. Circumferentially spaced vertically extending serrations or teeth 89 are located in the wall just beneath surface 88. These serrations interfit with serrations 90 on the inner surface on the rim of the lid in the regions just above and between teeth 84 when the lid is properly fitted on the body.

As the lid is pressed onto the body, surfaces 88 and 84*a* interengage to cause a flexure of the lid flange 83 outwardly. With continued pressure, the upper portion of the body wall rides up over the teeth surfaces 84*a* until the locking surfaces 84*b* of teeth 84 interlock with undercut surface 88*b* on the body. With the parts in interconnected position, the surface portion 87 tends to be flexed outwardly. A positive compression seal between surface 87 and the surface of sealing ring 86 is accomplished. The serrations 89 and 90 interengage, preventing rotation of the lid relative to the body. The seal cannot be broken nor the lid removed without destruction to the cartridge.

With reference to FIG. 4, the mounting of a mechanical filter over the activated carbon-containing cartridge can be seen. The mechanical filter is a felted fibrous disk 92 of a type well known in the art. In order to hold the mechanical filter 92 in place, the invention provides a retainer cup 93 formed of a flexible plastic material such as polyethylene. The retainer cup 93 is provided with a top opening 94 for intake of air and an outer wall portion 95 in which an annular detent ring 96 is formed. The ring fits over a bead 97 just adjacent the lower outer edge of the flange 83 of the cartridge lid. An inner downwardly-depending annular sealing ring 98 clamps the filter media against the upper surface of the lid, as seen in FIG. 4.

FIG. 5 illustrates the mechanical filter retainer in the configuration in which the chemical cartridge is not required. When used in this mode, the base member 55, which as explained above has a bayonet coupling of the type used on chemical cartridge is mounted directly on the inhalation valve fitting. Retainer housing 14 is provided with a second annular retaining ring 101 spaced above retaining ring 96 so as to fit over the outer edge of base 55 when the retainer housing is properly mounted. When base 55 is used, the filter is supported by radiating ribs 102 and 103 and captured by sealing ring 98 which presses the filter against an annular surface 104 adjacent the circumference of the base 55.

Reference is now made to FIGS. 13 and 14 which illustrate an exhalation valve utilized in the present invention. The valve, generally indicated by the number 105, is shown mounted in housing or fitting 15 which is intended to fit within any one of the three face mask ports 13. For this purpose the fitting 15 has an outer circumferential groove 106, the groove being dimensioned to receive the face mask wall and being of substantially the same diameter as any of the face mask ports. In accordance with the invention, valve 105 is formed of a thin flexible rubber material. The valve is disk-shaped and has a stem 107 which fits within a hub 108 supported on spokes 109. As best seen in FIG. 14, the valve seats on a ring-like sealing surface 110 when in the closed position with its periphery extending beyond the ring. Preferably, the valve is umbrella-shaped with its concave side facing towards the sealing ring 110. A multiplicity of radial ribs 112 are formed integrally on the concave side with the disk-shaped valve and act to bias the valve towards the position shown in full lines in FIG. 14. The ribs terminate just short of sealing ring 110. The number of ribs may vary somewhat depending on the degree of flexibility required. The ribs must be of sufficient number to prevent a folding of the valve about a single transverse axis and an imperfect seal with sealing ring 110. Too many ribs may impart so much stiffness to the valve as to cause too much breathing resistance. Twelve ribs produce excellent results although the number may vary somewhat.

Preferably, the valve is provided with a removable cover 113 which is connected to the fitting by means of a tether 114. Cover 113 has a central circular baffle 115 surrounded by annular openings 116. Various features of the valve contribute to the effectiveness of the invention. The relatively small diameter of passageway 117 through the fitting tends to produce a relatively high pressure zone on the back of the valve as the user is exhaling, thereby causing the valve to open rapidly and fully during exhalation. At the same time, baffle 115 tends to promote a dead air space which provides a blanket of $CO_2$ which in turn helps to prevent contaminants from entering through the exhalation valve. At the same time, the baffle 115 helps to protect the valve from paint and other sprays which may be harmful to the valve material. It should be noted that the side walls of the cover are sloped inwardly slightly, being spaced far enough from the periphery of the valve so that clearance is provided for flow of exhaled air in any position of valve flexure, yet not so far inwardly as to prevent the creation of the dead air space.

An important feature of the multiplicity of radiating ribs is that a uniform biasing force is applied circumferentially around the valve, producing a reliable, uniform, circumferential seal following exhalation. In addition, during exhalation, the ribs act to inhibit valve flutter and cause the valve to respond quickly at the end of the exhalation phase. It has further been found that valves made according to the invention may be much softer and thinner than before thereby promoting prompt response with minimal respiratory effort. Valves so formed, having a thickness of 0.014 inches and a durometer value of 30 Shore A± may be used and are found to produce excellent results.

We claim:

1. A disposable filter cartridge adapted for use with a respirator having an inhalation port, the cartridge comprising body and lid components, one of said components having separable means for connecting the cartridge with the respirator and having an opening adapted to communicate with the inhalation port of the respirator and the other of said components having an opening adapted to communicate with the surrounding atmosphere, the body and lid components defining a filter chamber having a flow axis extended between the body and lid openings, and the filter chamber having an imperforate side wall surrounding the filter chamber, a filter in said filter chamber, the volume of the filter being sufficient to extend transversely of the flow axis to the surrounding side wall of the filter chamber and thereby inhibit inhalation except through the filter, the filter being insertable into the filter chamber only when the body and lid components are disassembled, the body and lid components having annular telescopically interengageable edge portions surrounding the filter chamber and providing an enclosed joint between the body and lid components, the edge portions having overlapping locking surfaces disposed within said enclosed joint and interengageable by pressure deflection applied to the body and lid components during telescopic interengagement of the annular edge portions of the body and lid components, the lid component having an annularly extending camming surface spaced inwardly from said edge portions, said camming surface being engageable with the edge portion of said body component and being configured to effect a compression seal between said components and the interengaged locking surfaces being configured to remain interengaged after interengagement by said pressure deflection and being substantially inaccessible in said enclosed joint, thereby preventing disassembly of the filter cartridge without destruction of at least part of the joint between the body and lid components.

2. A filter cartridge assembly according to claim 1, said telescopically interengageable edge portions having transversely extending interengageable teeth within said enclosed joint.

3. A filter cartridge adapted for use with a respirator having an inhalation port, the cartridge comprising body and lid components, one of said components having separable means for connecting the cartridge with the respirator and having an opening adapted to communicate with the inhalation port of the respirator and the other of said components having an opening adapted to communicate with the surrounding atmosphere, the body and lid components defining a filter chamber having a flow axis extended between the body and lid openings, and the filter chamber having an imperforate side wall surrounding the filter chamber, a filter in said filter chamber, the volume of the filter being sufficient to extend transversely of the flow axis to the surrounding side wall of the filter chamber and thereby inhibit inhalation except through the filter, the body and lip components having telescopically interengageable edge portions surrounding the filter chamber, and the body and lid having annularly complete surfaces interengageable with each other upon telescopic interengagement of the edge portions of the body and lid, said annularly complete surfaces including an inclined camming surface on one of said components, said camming surface being disposed to effect a compression seal with the edge portion of the other of said components when the edge portions are telescopically interengaged thereby inhibiting gas flow between the filter chamber and the atmosphere surrounding the cartridge when the interengageable edge portions of the body and lid are telescopically interengaged.

4. A filter cartridge according to claim 3 adapted for use with a respirator wherein the edge portions have serrations paralleling the axis of the filter chamber and being axially interengageable during telescopic interengagement of the annular edge portions of the body and lid components.

5. A filter cartridge as defined in claim 4 in which the edge portions of the body and lid components further comprise locking lugs on one of said edge portions interengageable with the other edge portion by pressure deflection applied to the body and lid components, the interengaged locking lugs being configured to remain interengaged after interengagement by said pressure deflection and being substantially inaccessible after assembly of the body and lid components.

6. A filter cartridge as defined in claim 5 in which at least one of the body and lid components are provided with projections extended axially of the circular filter and arranged to project into at least one of the side faces of the circular filter and thereby provide against relative movement of the filter media contained within the body and lid components.

* * * * *